US006851403B2

(12) United States Patent
Dürr et al.

(10) Patent No.: US 6,851,403 B2
(45) Date of Patent: Feb. 8, 2005

(54) VALVE DRIVE HAVING A ROCKER ARM

(75) Inventors: Bernhard Dürr, Stuttgart (DE); Bruhns Imke, Fellbach (DE); Jürgen Häberlein, Murrhadt (DE); Harald Schliemann, Waiblingen (DE); Jörg Schlossarczyk, Winnenden (DE); Manfred Rabis, Schomdorf (DE)

(73) Assignee: Andreas Stihl AG & Co. (DE)

( * ) Notice: Subject to any disclaimer, the term of this patent is extended or adjusted under 35 U.S.C. 154(b) by 10 days.

(21) Appl. No.: 09/945,230

(22) Filed: Aug. 31, 2001

(65) Prior Publication Data

US 2002/0062805 A1 May 30, 2002

(30) Foreign Application Priority Data

Sep. 2, 2000 (DE) ..... 100 43 234

(51) Int. Cl.[7] ..... F01L 1/18

(52) U.S. Cl. ..... 123/90.42; 123/90.44; 123/90.47

(58) Field of Search ..... 123/90.41, 90.42, 123/90.39, 90.4, 90.43, 90.44, 90.45, 90.46, 90.47

(56) References Cited

U.S. PATENT DOCUMENTS 3,251,350 A * 5/1966 Thompson ..... 123/90.41
4,221,199 A * 9/1980 Buuck et al. ..... 123/90.16
4,256,070 A * 3/1981 Mueller ..... 123/198 F
4,440,121 A * 4/1984 Clancy et al. ..... 123/90.39
4,653,441 A * 3/1987 Belsanti ..... 123/90.39
4,676,203 A * 6/1987 Nouno ..... 123/90.42
4,762,099 A * 8/1988 Fujii et al. ..... 123/90.44
4,784,095 A * 11/1988 Golding et al. ..... 123/90.41
4,856,467 A * 8/1989 Kronich ..... 123/90.43
4,934,323 A * 6/1990 Grinsteiner ..... 123/90.42
5,190,000 A * 3/1993 van Schaik et al. ..... 123/90.39
5,323,741 A * 6/1994 Holzapfel et al. ..... 123/90.41
5,645,025 A * 7/1997 Caya et al. ..... 123/90.42

* cited by examiner

*Primary Examiner*—Thomas Denion
*Assistant Examiner*—Jaime Corrigan
(74) *Attorney, Agent, or Firm*—Robert W. Becker & Associates; Robert W. Becker

(57) ABSTRACT

A valve drive having a rocker arm mounted on a cylinder head is provided. One end of the rocker arm is actuated by a push rod to actuate a valve stem of a poppet valve that engages the other end of the rocker arm, which is pivotably held between its ends on a support pin that extends into the cylinder head, with a spherical mounting being provided between the support pin and the rocker arm. Provided on that side of the rocker arm remote from the cylinder head is a bolt head for adjusting the bearing spacing between the rocker arm and the cylinder head for adjusting valve play. To prevent unintended adjustment of the bolt head, the latter cooperates with a rotation preventing element that has an arresting portion that engages the bolt head, and a support portion that conveys the adjustment moment away.

18 Claims, 10 Drawing Sheets

VALVE DRIVE HAVING A ROCKER ARM

BACKGROUND OF THE INVENTION

The present invention relates to a valve drive mechanism having a rocker arm that is mounted on a cylinder head.

Small four-stroke engines such as are used in manually guided implements such as power chain saws, brush cutters, blowers, or the like require valve drives that have a simple construction and a small size. In order to save weight, the rocker arms, which are actuated by push rods, are embodied as components shaped from sheet metal, and are held on the cylinder head by support pins, whereby the pivot mounting of the rocker arm is embodied as a spherical mount. The valve stem of the poppet valve is engaged by one end of the rocker arm and is pressed firmly by the valve spring, as a result of which the rocker arm tends to pivot the mounting that is disposed between its ends. This is prevented by the push rod of the valve drive that engages at the other end of the rocker arm. The opening position of the poppet valve can therefore be varied with such a mounting by tightening or loosening the support pin, i.e. an adjustment nut that is threaded onto the support pin. In so doing, however, one must ensure that after adjustment of the valve play a securement of the pin or bolt head is effected in order to prevent an unintended altering of the valve play.

It is therefore an object of the present invention to provide a securement for the adjustment screw on the rocker arm of a valve drive that is easy to service has a straightforward configuration and does not adversely affect the overall height of the valve drive.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The valve drive mechanism of the present invention comprises a rocker arm that can be mounted on a cylinder head and is pivotable about a pivot axis that extends transverse to the rocker arm; a control unit that acts upon one end of the rocker arm for actuating a poppet valve having the valve stem upon which the other end of the rocker arm acts; a support pin that can be connected to the cylinder head, with the rocker arm being held on the support pin between the ends of the rocker arm; a bolt head that is disposed on the support pin on a side of the rocker arm remote from the cylinder head, wherein the bolt head serves for adjusting a bearing spacing between the rocker arm and the cylinder head for varying valve play; and a rotation preventing element that cooperates with the bolt head, wherein this element is provided with an arresting portion that engages the bolt head, and a support portion that conveys an adjustment moment away.

Thus, the bolt head cooperates with a rotation preventing element that comprises an arresting portion that engages the bolt head, and a support portion that conveys away the adjustment moment. In this connection, the support portion can be supported against the valve stem, the rocker arm or the cylinder head.

The rotation preventing element is preferably a spring element, the arresting portion of which rests resiliently against an arresting surface of the bolt head. The spring element can, for example, be a spring clip of spring wire or the like having a circular or preferably multi-sided cross-sectional configuration.

The bolt head is advantageously embodied as a multi-sided head, and is disposed between the longitudinal walls of a U-shaped rocker arm. In this connection, the greatest diameter of the multi-sided head, as measured from corner to corner, is slightly greater than the distance between the two longitudinal walls as measured transverse to the rocker arm.

If at least one of the longitudinal walls is resiliently yieldable in the contact region, the bolt head can be easily adjusted with a torque of appropriate magnitude, and yet unintentional release or adjustment is prevented due to the resiliently contacting longitudinal walls.

Further specific features of the present invention will be described in detail subsequently.

DESCRIPTION OF PREFERRED EMBODIMENTS

Figure 1:
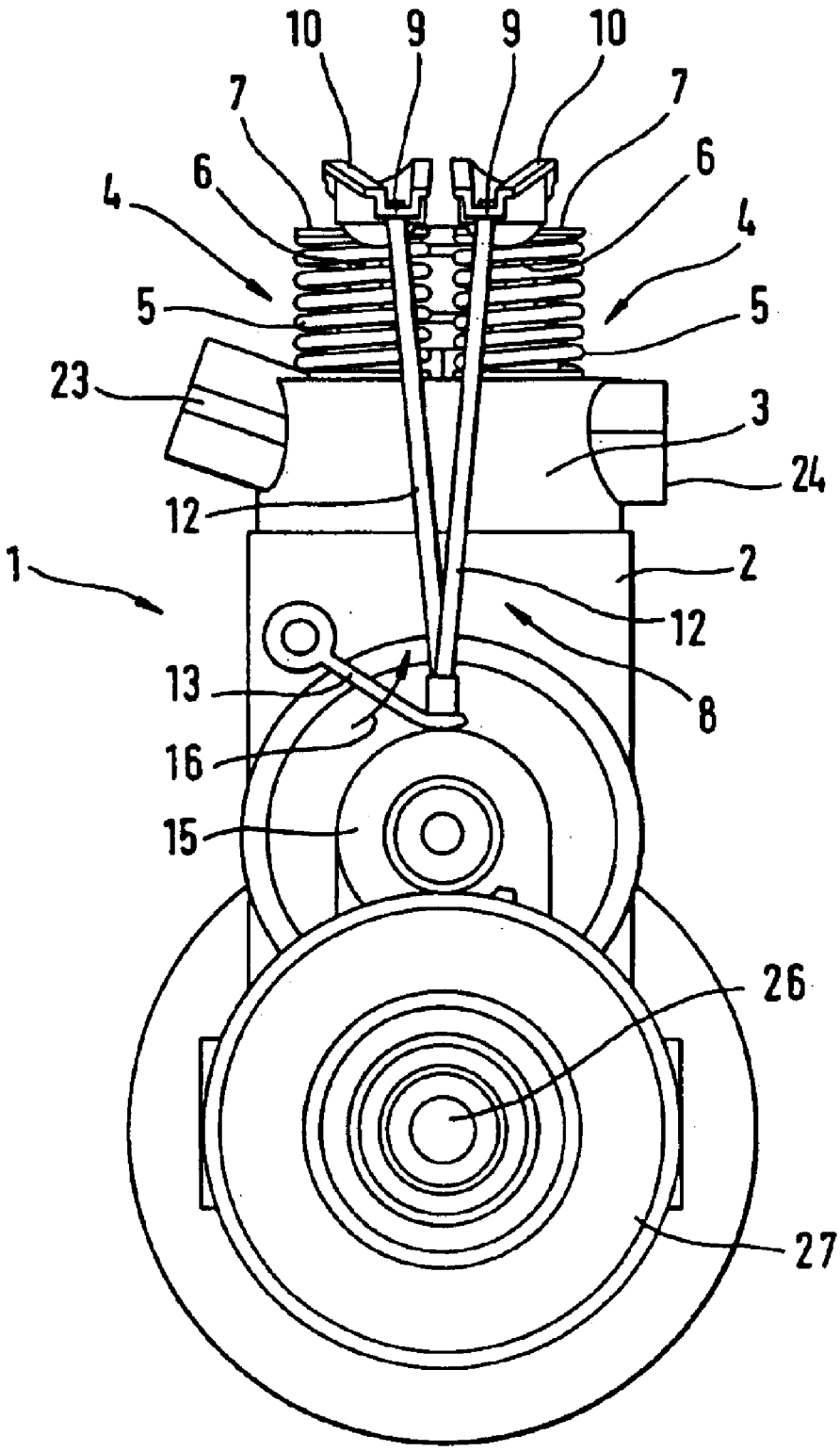
FIG. 1 is a view of a four-stroke engine having poppet valves that are actuated by push rods.

The internal combustion engine 1, which is schematically illustrated in FIG. 1, essentially comprises a cylinder 2 in the cylinder head 3 of which are provided gas-change or poppet valves 4 that are not shown in detail. As can be seen from FIG. 1, the valve springs 5 surround the valve shafts or stems 6. Each valve spring 5 is supported on one end against the cylinder head 3 and at the other end against a valve disc 7, which is secured to the valve stem so that it cannot shift axially.

Each valve stem 6 of the poppet valve 4 is actuated by means of a control unit 8, which acts upon one end 9 of the rocker arm 10 that is mounted on the cylinder head 3. The end of the valve stem 6 of a poppet valve 4 rests against the other end 11 of the rocker arm 10 (see FIG. 4).

The control unit 8 essentially comprises respective push rods 12 that are associated with each of the rocker arms 10. One end of each push rod 12 is held on a respective drag lever 13, while the other end of the push rod is fixed in position in a recess 14 in the end 9 of the rocker arm 10.

The drag lever 13 rests upon the surface of a control cam 15 and in conformity with the shape of the cam actuates the drag lever 13 in the direction of the arrow 16. In so doing the push rod 12 is pressed in the same direction 16, as a result of which the rocker arm 10 is pivoted about its pivot axis 17, which is disposed transverse to the longitudinal direction of the rocker arm. For this purpose, the rocker arm 10 is held on the cylinder head 3 by means of a support pin 18.

The support mechanism is formed from a ball socket 19 (see FIGS. 3 and 14) that is formed on the rocker arm 10 and cooperates with a corresponding hemispherical bearing portion 20 of the support pin 18. In the illustrated embodiment, the support pin 18 is a bearing bolt that is tapped into the cylinder head 3; the shaft 21 of the bolt extends from the cylinder head 3 and is provided with a thread onto which is threaded a bolt head 22 that has the form of a nut. In the embodiment illustrated in FIGS. 1 to 5, the bolt head 22 is monolithically formed with the hemispherical bearing portion 20. As a consequence of how far the bolt head 22 is threaded on, the bearing spacing "l" relative to the cylinder head 3 can be varied, as a result of which the valve play can be adjusted.

Figure 2:
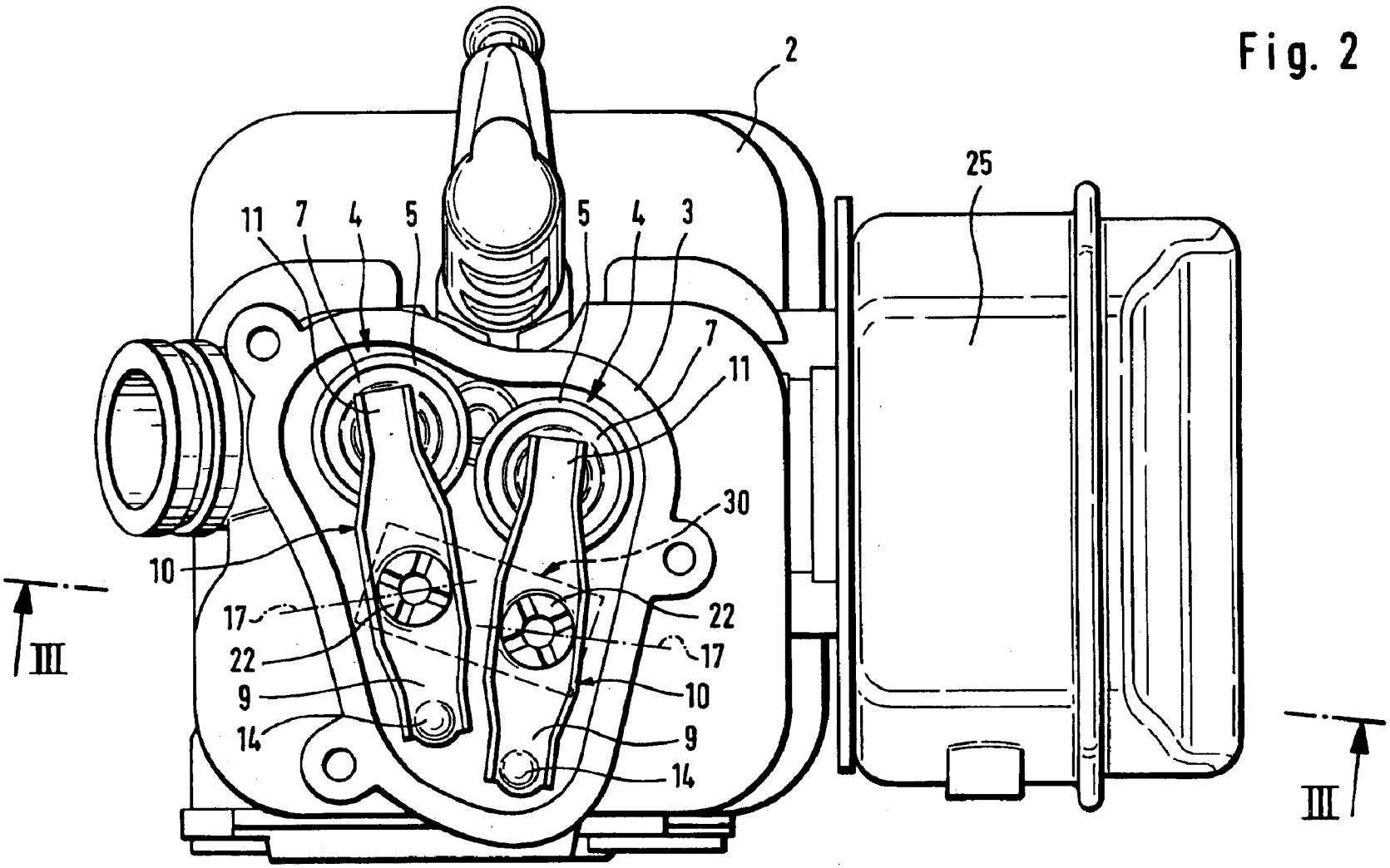
FIG. 2 is a top view of the four-stroke engine of FIG. 1 with the valve cover opened.
Figure 3:
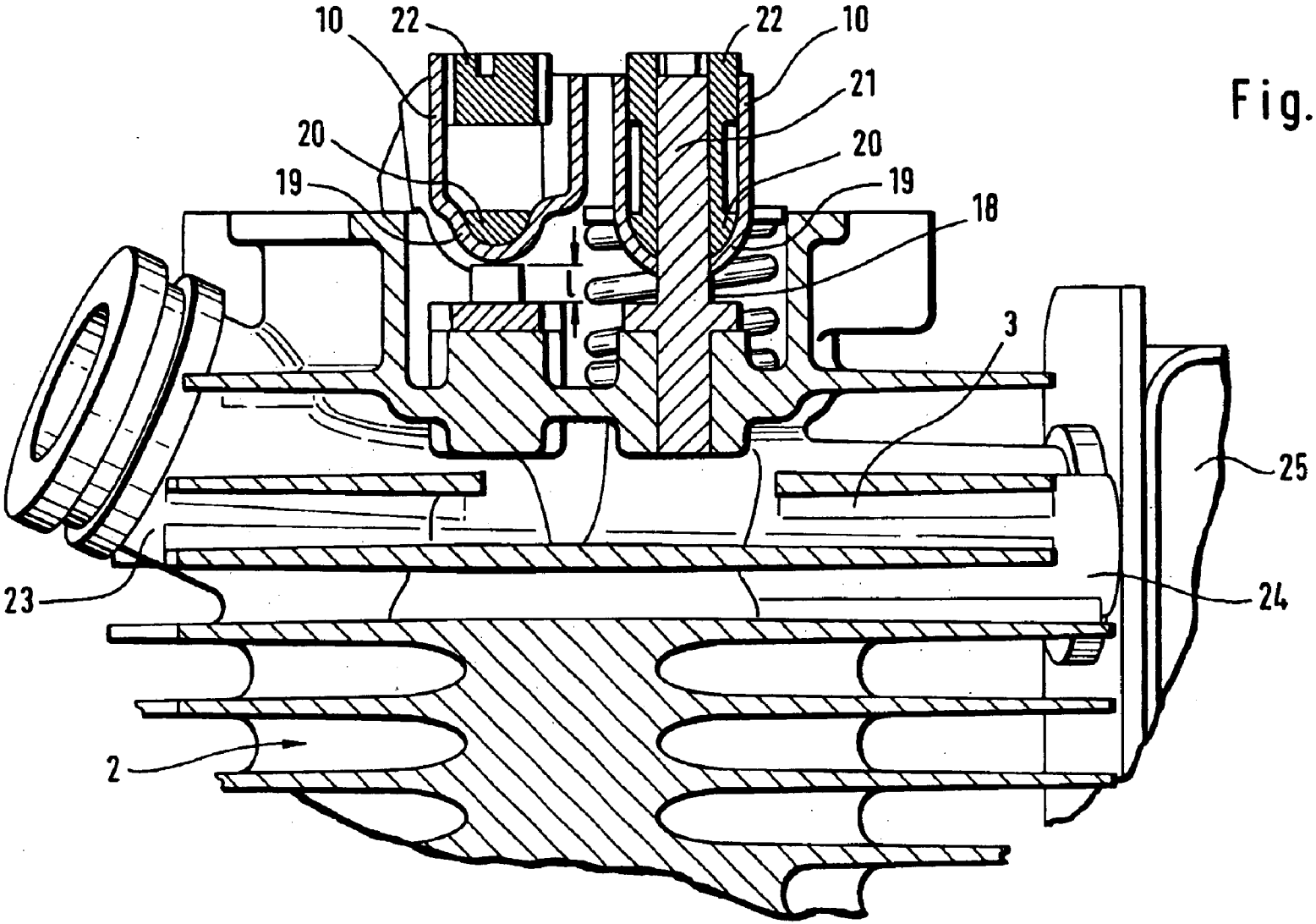
FIG. 3 is a partial cross-sectional view taken along the line III—III in FIG. 2.

Upon actuation of the push rod 12, the rocker arm 10 pivots about the spherical support and presses the respective valve stem 6 of the poppet valve 4 down in order to open the intake or exhaust valve. The intake valve communicates with an intake channel 23 by means of which the intake mixture is supplied. The exhaust valve communicates with an exhaust gas channel 24 that opens into a muffler 25 (FIG. 2).

The control cams 15, which are preferably separately embodied for the intake valve and the exhaust valve, are driven from the crankshaft 26 of the internal combustion engine, preferably via a gear drive, a chain drive or a belt drive. The crankshaft 26 rotates in a crankcase 27.

The rocker arm 10 of the valve drive is spring loaded by the respective valve spring 5. The spring force acts via the end 11 of the rocker arm 10 upon the push rod end 9 thereof, and via the push rods 12 upon the drag lever 13, so that the latter is held against the surface of the control cam 15. If the bolt head 22 is threaded further onto the shaft 21 of the support pin 18, the bearing spacing is reduced, so that, since the push rod 12 cannot deflect, a pivoting of the rocker arm 10 is effected and the valve stem 6 is pressed down. In the opposite direction, in other words if the bolt head 22 is unthreaded some, the valve stem 6 is displaced by the valve spring 5 in a direction of closing the poppet valve 4. By rotating the bolt head 22 and altering the bearing spacing "l", adjustment of the valve play at the poppet valve 4 is thus possible. In order during operation of the internal combustion engine 1, which can advantageously be a mixture lubricated four-stroke engine or two-stroke engine, to avoid an unintended adjustment of the bolt head 22 and hence an unintended altering of the valve play, an element 30 for preventing rotation is provided. In the embodiment illustrated in FIGS. 4 and 5, the rotation preventing element 30 is formed by the cooperation between the bolt head 22 and the rocker arm 10, which is preferably formed from sheet metal.

Figure 4:
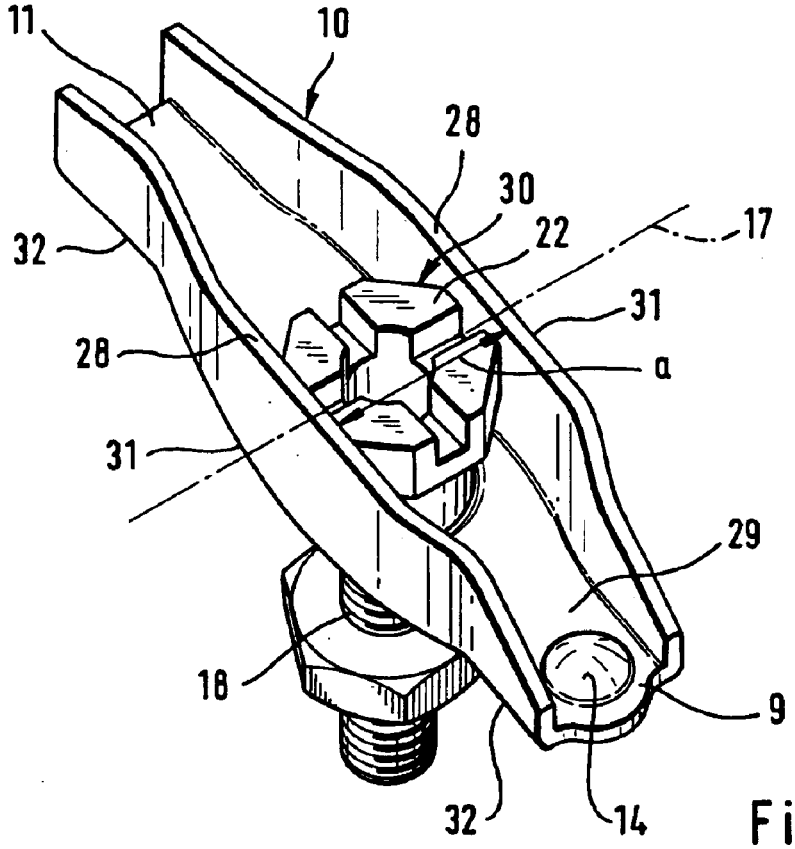
FIG. 4 is a perspective view of a rocker arm held on a support pin.

The rocker arm 10 is expediently a formed part having lateral longitudinal walls 28 that provide the necessary stability for reinforcing the base 29 of the rocker arm. At least one of the longitudinal walls 28, and in the embodiment illustrated in FIG. 4 both of the longitudinal walls 28, form a stop or arresting portion 31 of the rotation preventing element 30. Associated with each arresting portion 31 is a support portion 32 of the rotation preventing element 30; in the embodiment illustrated in FIG. 4, each support portion 32 extends in the longitudinal direction of the rocker arm 10 to both sides of the arresting portion 31. In the embodiment of FIG. 4, the support portions 32 are formed by the end portions of the longitudinal walls 28.

Figure 5:
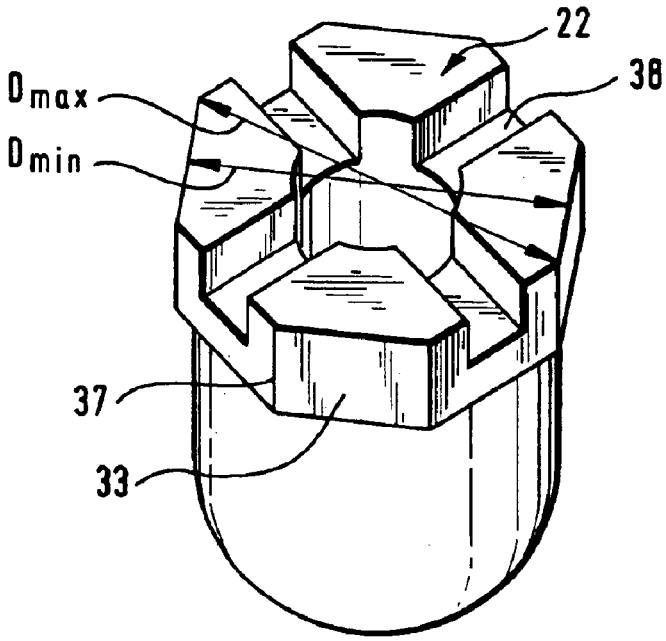
FIG. 5 is a perspective view of a bolt head that is screwed onto the support pin.

Formed on the bolt head 22, which is embodied as a multi-sided head, are stop or arresting surfaces 33, whereby in the embodiment illustrated in FIGS. 4 and 5 eight identical arresting surfaces 33 are provided about the periphery of the bolt head 22. Depending upon the desired fineness of the adjustment for the valve play, a greater or fewer number of surfaces 33 can be uniformly distributed over the periphery of the head.

In the mounted position of FIG. 4, the bolt head 22 is disposed between the longitudinal walls 28, whereby engagement slots 38 are formed in the end face of the bolt head 22 for the engagement of an adjustment tool.

In the position of the bolt head 22 shown in FIG. 4, the arresting portions 31 of the rotation preventing element 30 rest against diametrically opposed arresting surfaces 33 of the bolt head 22. In this connection, the bolt head 22 is dimensionally coordinated relative to the rocker arm 10 in such a way that the greatest diameter $D_{max}$ of the multi-sided head, as measured over the corner 37, is slightly greater than the distance or spacing "a" of the two longitudinal walls 28 relative to one another measured transverse to the rocker arm 10. In addition, the spacing $D_{min}$ measured between two diametrically opposed arresting surfaces 33 is preferably the same or slightly greater than the spacing "a", so that a clamping or wedging that is preferably free of play of the multi-sided head 22 between the arresting portions 31 of the rotation preventing element 30 is provided. The diameter $D_{min}$ is less than the diameter $D_{max}$, so that in order to turn the multi-sided head 22, a threshold moment must be overcome. When the bolt head 22 is rotated, the longitudinal walls 28 resiliently yield, at least in the abutment region, namely in the region of the arresting portions 31. This is possible without compromising the stability of the rocker arm 10 due to an appropriate structural configuration. It can be expedient to provide spring elements, such as leaf springs or the like, in the longitudinal walls 28 of the rocker arm 10 at the level of the bolt head 22 to effect a rotation of the bolt head 22 accompanied by elastic expansion of the rocker arm 10 in the region of the maximum diameter $D_{max}$ of the bolt head 22.

It can be advantageous to rotatably dispose the bolt head 22 between the longitudinal walls 28 of the rocker arm 10; as a rotation preventing element 30, a spring clip 34 can then advantageously be provided, with the ends 35 thereof being supported in the cylinder head 3. The arresting portion 31 of the rotation preventing element 30 is then provided in the central region of the spring clip 34 between the ends 35 thereof; the rotation preventing element 30 then rests with preload against the periphery of the bolt head 22. The suport portion 32 of the rotation preventing element 30 is then formed by the end 35 that is supported against the cylinder head 3.

Figure 6:
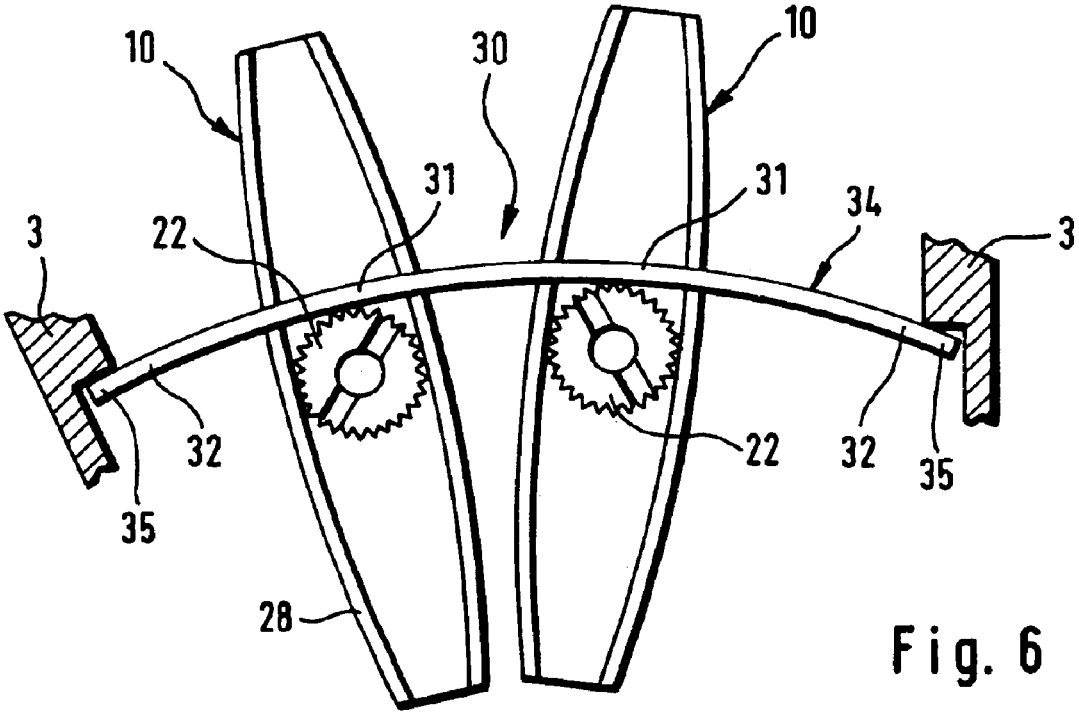
FIG. 6 is a view of a rotation preventing element in the form of a spring clip.

To enable a reliable support of the spring clip 34, a circumferential groove 36 is formed in the bolt head 22, with the groove 36 having a diameter or width that is coordinated to the spring clip 34. With such a configuration of the bolt head 22, the spring clip 34 is reliably guided in the region of the bolt heads 22 in the respective circumferential grooves 36, so that the ends 35 of the spring clip 34 need merely be supported in the cylinder head 3 in such a way that in the contact region the spring clip 34 rests against the bolt heads 22 under spring force (see FIG. 6). In this way, a frictional engagement results between the arresting portions 31 of the spring clip 34 and the circumferential groove 36; the frictional engagement prevents a disengagement moment that might occur during operation. By means of the support portion 32, the forces that occur in this connection are conveyed into the cylinder head 3. It can be expedient for the cross-sectional configuration of the spring clip 34 to deviate from the circular configuration shown in FIG. 7, and to rather be multi-cornered, preferably rectangular or square, as shown in FIG. 8. With such a configuration, the bolt head 22, in conformity with FIG. 5, can be a multi-sided head, whereby an adjustment of the multi-sided head for establishing the valve play is possible only by overcoming the force encountered when passing over the corners 37 of the multi-sided head 22. With such a configuration, the ends 35 of the spring clip 34 are preferably secured in the cylinder head 3 for a reliable guidance.

Figure 9:
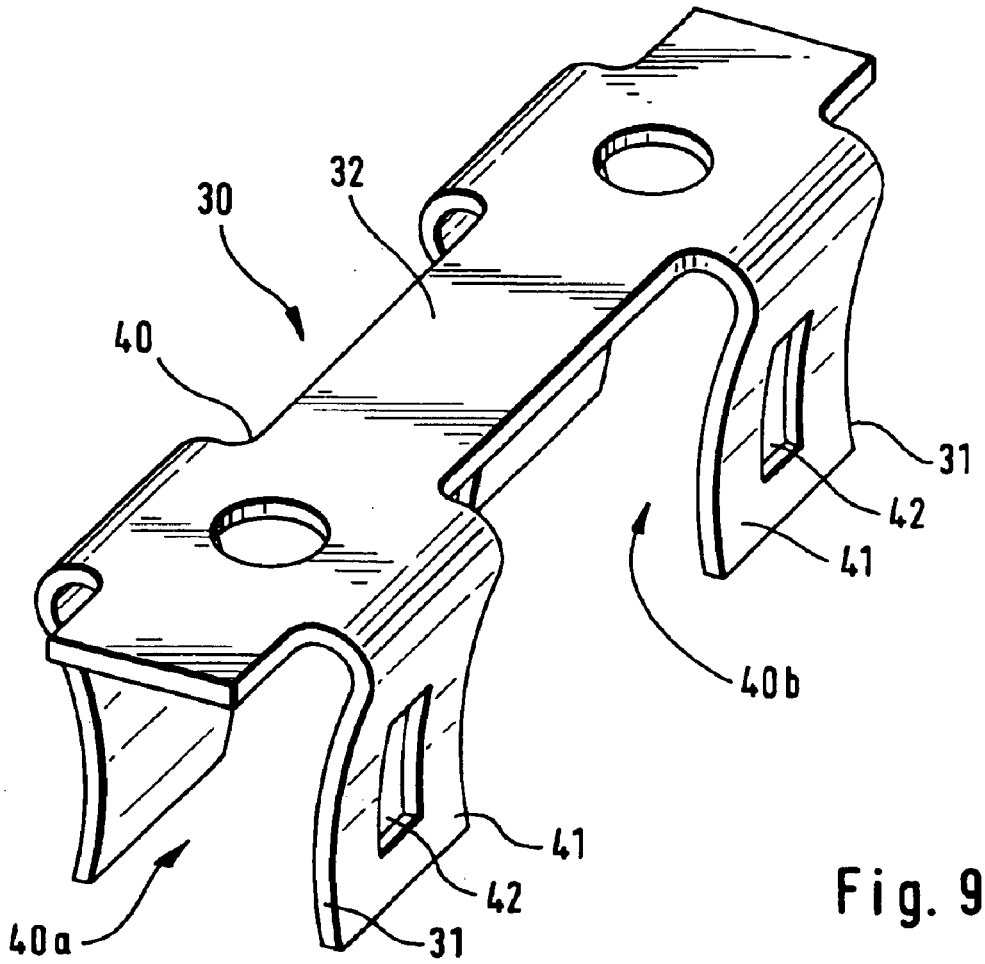
FIG. 9 is a perspective view of a double clamp as a rotation preventing element.
Figure 10:
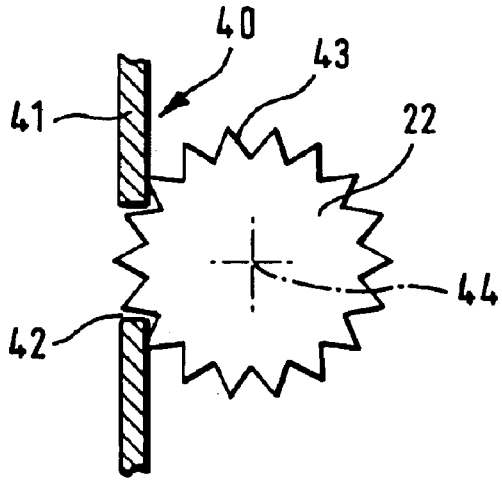
FIG. 10 is a view showing engagement of the knurling of the bolt head in arresting slots of the clamp leg.

It can be expedient to embody the rotation preventing element 30 as a component that is separate from the rocker arm 10 and the bolt head 22. In the embodiment illustrated in FIGS. 9 and 10, a clamp 40 is provided that has an approximately U-shaped cross-sectional configuration; as shown by the dashed lines in FIG. 2, the clamp 40 spans the rocker arm 10 adjacent to the bolt heads 22. In this connection, the first clamp 40*a* spans the bolt head 22 of the intake valve, while the other clamp 40*b* at the same time spans the bolt head 22 of the exhaust valve. The legs 41 of the clamps 40*a* and 40*b* are disposed transverse to the longitudinal direction of the rocker arm 10 and extend over the bolt head 22. In the embodiment of FIGS. 9 and 10, a slot 42 is provided in the legs 41; the slot 42 cooperates with a knurling 43 of the bolt head 22. The bolt head 22 is clamped in between those legs 41 that are diametrically opposite one another relative to the longitudinal axis 44 of the bolt, thus preventing an unintentional adjustment of the bolt head 22. By means of the support portion 32 between the clamps 40*a* and 40*b*, a torque that might act upon one of the bolt heads 22 is supported against the respectively other bolt head 22.

Figure 11:
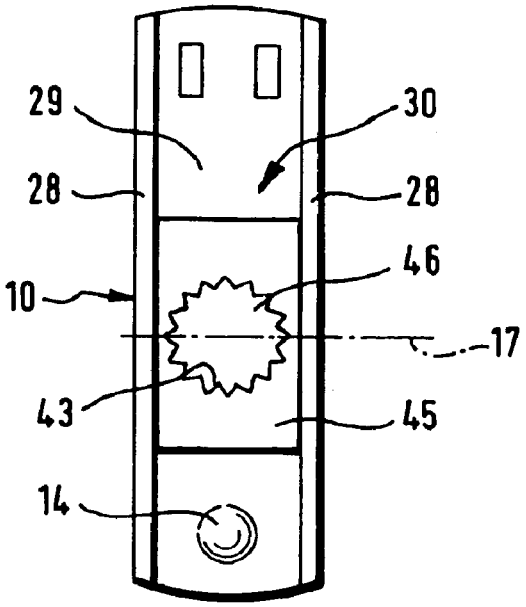
FIG. 11 is a top view of a rocker arm having a plug as a rotation preventing element.

In the embodiment illustrated in FIG. 11, the rotation preventing element 30 is embodied as a plug 45 that is pressed between the longitudinal walls 28 of the rocker arm 10, which has a U-shaped cross-sectional configuration; the plug 45 extends in particular in an interlocking manner over the bolt head 22. For this purpose, the plug 45 has an inner receiving opening 46 that is embodied in conformity with the outer configuration of the bolt head 22, for example a knurling 43. The receiving opening 46 forms the arresting portion 31 of the rotation preventing element 30, which arresting portion engages on the bolt head 22 in a frictional or interlocking manner; the plug 45 itself, due to its interlocking positioning, forms the support portion 32 between the longitudinal walls 28 of the rocker arm 10, via which support portion disengagement moments that occur are conveyed to the rocker arm 10.

Figure 12:
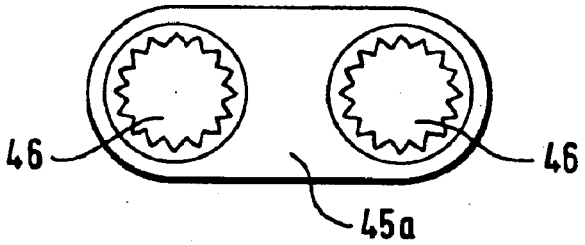
FIG. 12 shows a plug as a double rotation preventing element.

FIG. 12 shows a plug 45*a* that in conformity with the double clamp 40 of FIG. 9 can be used for bolt heads of two rocker arms 10 that are disposed next to one another. The double plug 45*a* of FIG. 12 provides the same effect as does the double clamp 40 of FIG. 9; the structural embodiment of the individual receiving openings 46 corresponds to that of the embodiment of FIG. 11.

It can be advantageous to dispose a rotation preventing element 30 in the form of a safety plug in the valve cover, so that when the valve drive mechanism is closed by installing the valve cover, at the same time the bolt heads 22 of the rocker arm 10 are prevented from rotating.

Figure 13:
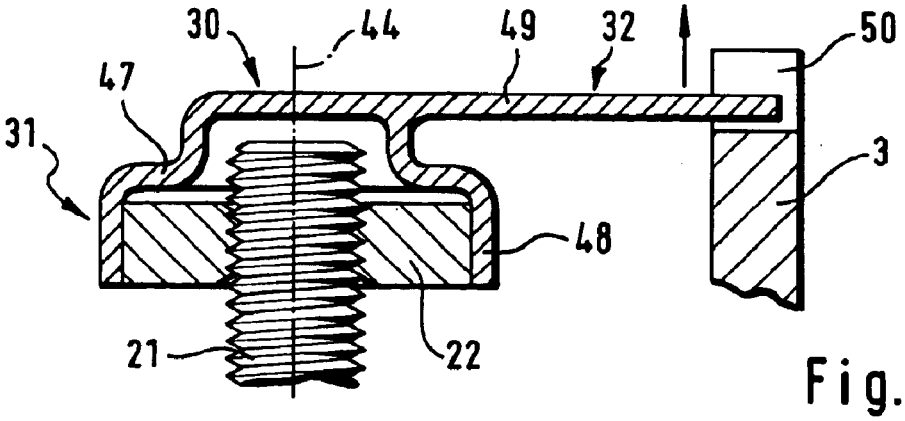
FIG. 13 shows a cap-shaped rotation securing element.

In the embodiment illustrated in FIG. 13, the rotation preventing element 30 is embodied as a hood or cap 47 that extends over the bolt head 22 in an interlocking or frictional manner. The receiving portion 48 of the cap 47 forms the arresting portion 31 of the rotation preventing element 30. The cap 47 is provided with a radially projecting extension 49, the free ends of which engage on the cylinder head 3 or also on the longitudinal wall 28 of the rocker arm 10. In so doing, the extension 49 forms the support portion 32 of the rotation preventing element 30. To adjust the bolt head 22, the extension 49 must be raised out of the securement opening 50 of the cylinder head 3, of the rocker arm 10, or of some similar element, as indicated by the arrow in FIG. 13.

Figure 14:
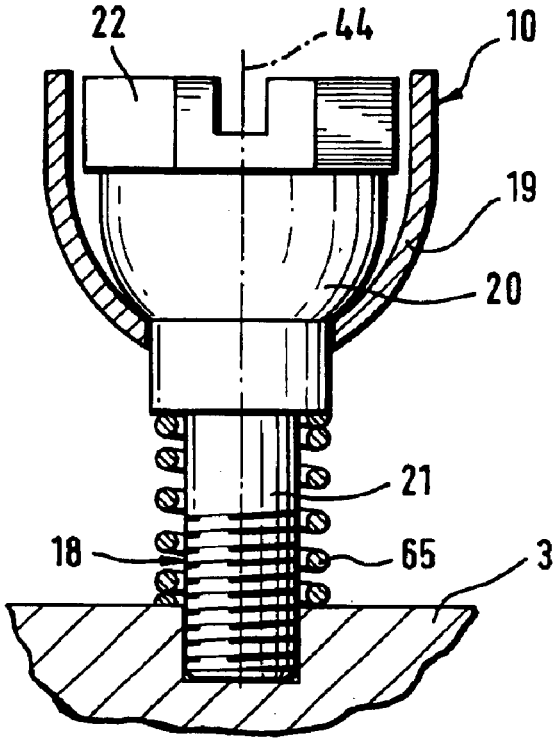
FIG. 14 is a partial cross-sectional view through a spherical mounting of a rocker arm.

The embodiment of FIG. 14 shows a cross-section through the spherical support of the rocker arm 10. Disposed coaxially relative to the support pin 18 is a helical spring 65 that acts between the base of the cylinder head 3 and the rocker arm 10. As a result, the ball socket 19 is pressed with frictional engagement against the bearing portion 20 of the support pin 18, i.e. of the bolt head 22, thus providing increased frictional engagement between the bearing portion 20 and the ball socket 19. This increased frictional engagement prevents a disengagement moment of the bolt head 22 from occurring during operation, thus providing prevention against rotation.

Figure 7:
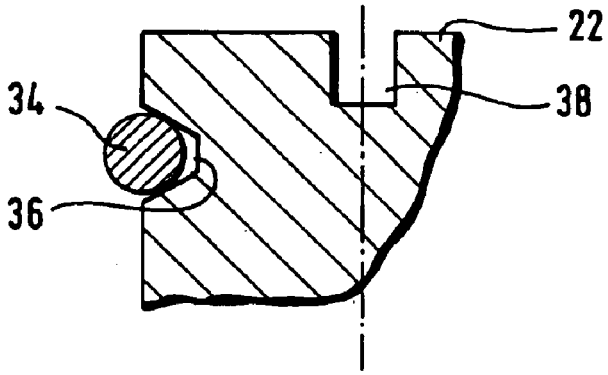
FIG. 7 is a partial sectional view through a bolt head having a circumferential groove.
Figure 8:
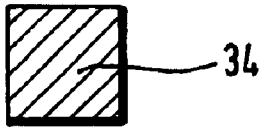
FIG. 8 is a cross-sectional view through the spring clip of FIG. 6.
Figure 15:
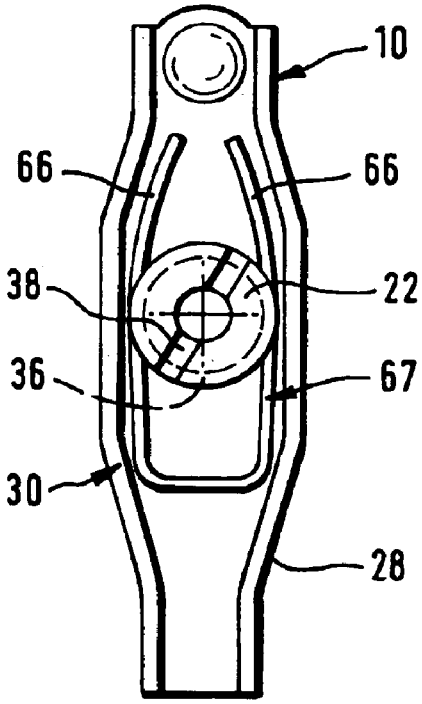
FIG. 15 shows a U-shaped spring clip as a rotation preventing element.
Figure 17:
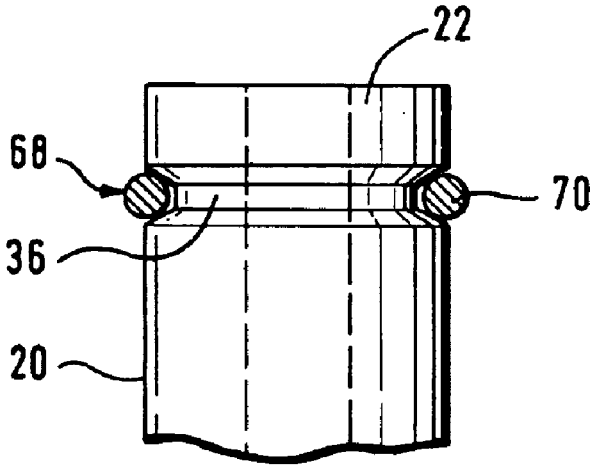
FIG. 17 is a partial section through the bolt head of FIG. 16.

In the embodiment illustrated in FIG. 15, the bolt head 22 has a circumferential groove 36 as also illustrated in FIG. 7 or 17. The legs 66 of a spring clip 67, which is bent in a U-shaped manner, engage in the circumferential groove 36. In so doing, the bolt head 22 is clamped between the legs 66 of the spring clip 67. The spring clip 67 forms the rotation preventing element 30, which is disposed between the longitudinal walls 28 of the rocker arm 10. If the bolt head 22 rotates, it takes the spring clip 67 along with it until the latter comes to rest against a longitudinal wall 28. An increased force must then be applied in order to overcome the frictional engagement between the bolt head 22 and the leg 66 of the spring clip 67. In this way, a simple securement is provided, whereby the arresting portion of the rotation preventing element 30 is formed by the legs 66 and engages in a frictional manner in the circumferential groove 36 of the bolt head 22. The support portion of the rotation preventing element 30 is formed by the remainder of the spring clip 67, which conveys a disengaging torque to the bolt head 22 by contacting a longitudinal wall 28 of the rocker arm.

Figure 16:
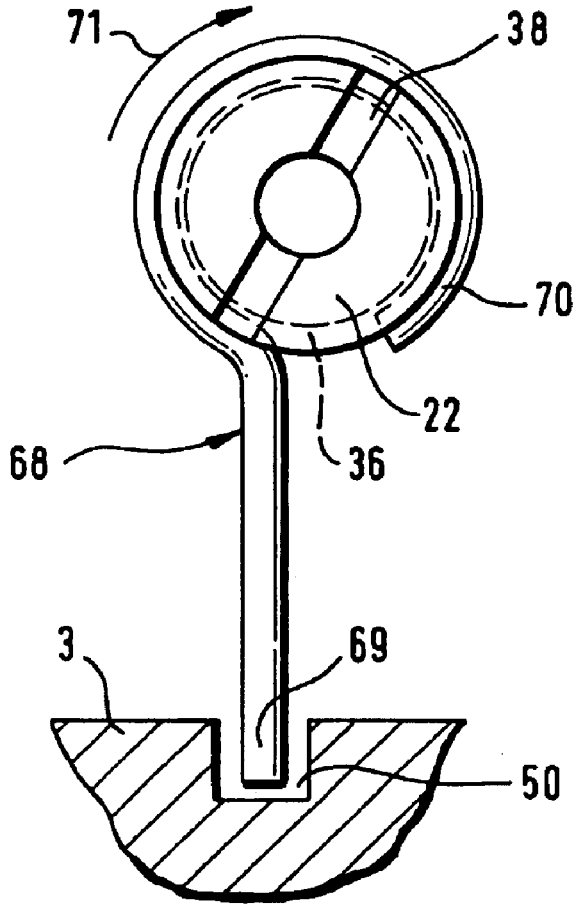
FIG. 16 shows a differently embodied spring clip as a rotation preventing element.

The embodiment illustrated in FIGS. 16 and 17 shows a spring clip 68 that has a first end 70 that is bent into the shape of a circle and a second elongated end 69. The diameter of the circular end 70 is slightly less than the engagement diameter of the circumferential groove 36 (FIG. 17), so that the circular end 70 extends about the bolt head 22 with preload in the region of the circumferential groove 36. The free end 69 of the spring clip 68 is disposed in a securement opening 50 of a housing portion, for example the cylinder head 3 or also the rocker arm 10. If an adjusting element acts upon the bolt head 22, this element is restrained by the frictional engagement between the circular end 70 and the circumferential groove 36. The forces that occur are removed via the end 69 that bears the torque.

It should be noted in the embodiment of FIG. 16 that when a disengaging moment occurs in the direction of the arrow 71, the circular end 70 draws together and thereby the initial break-away moment between the spring clip 68 and the bolt head 22 increases. For an adjustment, the free end 69 must be raised out of the securement opening 50.

Figure 18:
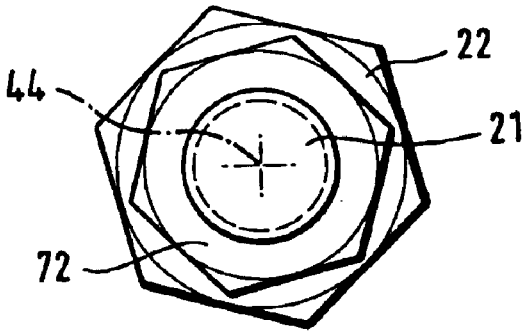
FIG. 18 is a top view of a bolt head having a lock nut as a rotation preventing element.

In the embodiment illustrated in FIG. 18, a lock nut 72 is screwed onto the threaded shaft 21 of the support pin 18 next to the bolt head 22; however, the size of the lock nut 72 is less than that of the bolt head 22. Thus, a lesser wrench width is required for the lock nut 72 than for the bolt head 22 itself. A combination tool can thus be used that engages the bolt head 22 with a large counter nut or socket in which is provided a small counter nut for engaging the lock nut 72. In this way, adjustment of the valve play is also easily possible with the bolt head 22 that is disposed between the longitudinal walls 28.

Figure 19:
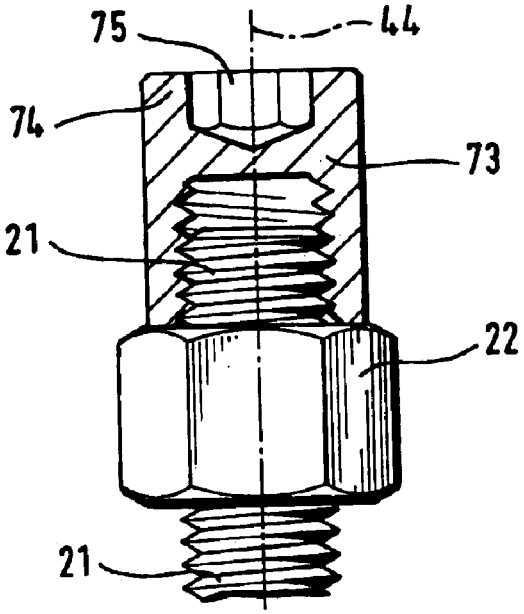
FIG. 19 is a cross-sectional view through a cap-shaped rotation preventing element.

In the embodiment illustrated in FIG. 19, the lock nut is embodied as a cap nut 73 that can be embodied in the same manner as in FIG. 18. In a particular embodiment, there is provided in the base 74 of the cap nut 73 an engagement opening 75 for an adjustment tool such as a key, an Allen wrench, or the like. In this connection, the engagement opening 75 can preferably be provided by a central opening in the socket of an adjustment tool for the bolt head 22.

Figure 20:
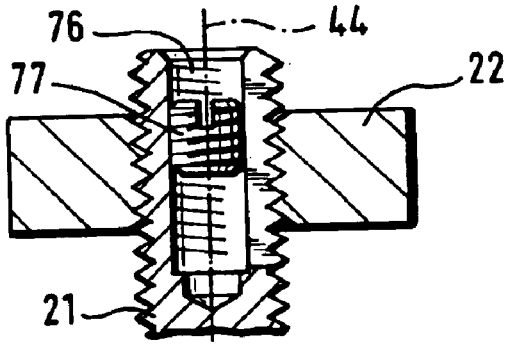
FIG. 20 is a cross-sectional view through a rotation preventing element for expanding the slotted end of the support pin.

In the embodiment illustrated in FIG. 20, to secure the bolt head 22 on the threaded shaft 21, a threaded blind hole 76 is provided in the threaded shaft itself, with a larger diameter set screw 77 being tapped into the blind hole 76. The threaded shaft 21 is slotted over the length of the blind hole so that when the larger set screw 77 is inserted, the slotted end of the bolt expands, thereby fixing the bolt head 22, which is embodied as a nut, in position so that it is prevented from rotating.

The specification incorporates by reference the disclosure of German priority document 100 43 234.4 of Sep. 2, 2000.

The present invention is, of course, in no way restricted to the specific disclosure of the specification and drawings, but also encompasses any modifications within the scope of the appended claims.

We claim:

1. A valve drive mechanism, comprising:

a rocker arm that is mountable on a cylinder head and is pivotable about a pivot axis that extends transverse to the rocker arm;

a control unit that acts upon a first end of said rocker arm for actuating a poppet valve having a valve stem upon which a second end of said rocker arm acts;

a support pin that is connectable to a cylinder head, wherein said rocker arm is held on said support pin between said first and second ends of said rocker arm;

a bolt head disposed on said support pin on a side of said rocker arm remote from a cylinder head, wherein said bolt head serves for adjusting a bearing spacing between said rocker arm and a cylinder head for varying valve play; and a rotation preventing element that cooperates with said bolt head, wherein said rotation preventing element is provided with an arresting portion that engages said bolt head, and a support portion that conveys an adjustment moment away, wherein said rocker arm is a shaped part having lateral longitudinal walls, at least one of which forms said arresting portion.

2. A valve drive mechanism according to claim 1, wherein said support portion is supported against said support pin, said rocker arm, or said cylinder head.

3. A valve drive mechanism according to claim 1, wherein said rotation preventing element is a spring element, the arresting portion of which rests resiliently against an arresting surface of said bolt head.

4. A valve drive mechanism according to claim 3, wherein said spring element is a spring clip of spring wire and wherein said spring wire has a circular cross-sectional configuration or a multi-sided, especially right angled, cross-sectional configuration.

5. A valve drive mechanism according to claim 1, wherein an interlocking connection is formed between said arresting portion of said rotation preventing element and an arresting surface of said bolt head.

6. A valve drive mechanism according to claim 1, wherein said support pin is non-rotatably fixed in said cylinder head, and wherein said bolt head is a nut that is threaded onto a shaft of said support pin.

7. A valve drive mechanism according to claim 1, wherein said rotation preventing element is effective between said longitudinal walls of said rocker arm.

8. A valve drive mechanism according to claim 1, wherein said bolt head is embodied as a multi-sided head and is disposed between said longitudinal walls of said rocker arm, wherein the greatest diameter of said multi-sided head, as measured from one corner to another thereof, is slightly greater than a distance between said two longitudinal walls as measured transverse to said rocker arm, and wherein at least one of said longitudinal walls, in a contact region thereof, is resiliently yieldable.

9. A valve drive mechanism according to claim 1, wherein said rotation preventing element spans said bolt head in a positively engaging manner.

10. A valve drive mechanism according to claim 9, wherein said rotation preventing element is placed axially upon said bolt head.

11. A valve drive mechanism according to claim 1, wherein said rotation preventing element is a spring clip that extends about said bolt head in a frictionally engaging manner.

12. A valve drive mechanism according to claim 1, wherein said rocker arm is provided with a ball socket in which a bearing portion of said support pin engages, and wherein said ball socket is pressed against said bearing portion in a frictionally engaging manner by means of a spring.

13. A valve drive mechanism according to claim 1, wherein bolt heads of rocker arms disposed next to one another are secured by means of a single rotation preventing element.

14. A valve drive mechanism, comprising:

a rocker arm that is mountable on a cylinder head and is pivotable about a pivot axis that extends transverse to the rocker arm;

a control unit that acts upon a first end of said rocker arm for actuating a poppet valve having a valve stem upon which a second end of said rocker arm acts;

a support pin that is connectable to a cylinder head, wherein said rocker arm is held on said support pin between said first and second ends of said rocker arm;

a bolt head disposed on said support pin on a side of said rocker arm remote from a cylinder head, wherein said bolt head serves for adjusting a bearing spacing between said rocker arm and a cylinder head for varying valve play; and a rotation preventing element that cooperates with said bolt head, wherein said rotation preventing element is provided with an arresting portion that engages said bolt head, and a support portion that conveys an adjustment moment away, wherein said rocker arm is a shaped part having lateral longitudinal walls, at least one of which forms said arresting portion, wherein said bolt head is embodied as a multi-sided head and is disposed between said longitudinal walls of said rocker arm, wherein the greatest diameter of said multi-sided head, as measured from one corner to another thereof, is slightly greater than a distance between said two longitudinal walls as measured transverse to said rocker arm, and wherein at least one of said longitudinal walls, in a contact region thereof, is resiliently yieldable.

15. A valve drive mechanism according to claim 14, wherein an interlocking connection is formed between said arresting portion of said rotation preventing element and an arresting surface of said bolt head.

16. A valve drive mechanism according to claim 14, wherein said support pin is non-rotatably fixed in said cylinder head, and wherein said bolt head is a nut that is threaded onto a shaft of said support pin.

17. A valve drive mechanism according to claim 14, wherein said rotation preventing element is effective between said longitudinal walls of said rocker arm.

18. A valve drive mechanism according to claim 14, wherein said rocker arm is provided with a ball socket in which a bearing portion of said support pin engages, and wherein said ball socket is pressed against said bearing portion in a frictionally engaging manner by means of a spring.

* * * * *